US006657113B2

(12) United States Patent
Herman

(10) Patent No.: US 6,657,113 B2
(45) Date of Patent: Dec. 2, 2003

(54) MOLDED FRETBOARD AND GUITAR

(75) Inventor: Alexander Béla Herman, 690 Old Sackville Road, Halifax, Nova Scotia (CA), B4C 2K3

(73) Assignee: Alexander Béla Herman, Halifax (CA)

( * ) Notice: Subject to any disclaimer, the term of this patent is extended or adjusted under 35 U.S.C. 154(b) by 94 days.

(21) Appl. No.: 10/061,020

(22) Filed: Jan. 30, 2002

(65) Prior Publication Data

US 2003/0140765 A1 Jul. 31, 2003

(51) Int. Cl.[7] ..... G10D 3/06
(52) U.S. Cl. ..... 84/314 R; 84/293
(58) Field of Search ..... 84/314 R, 293, 84/290

(56) References Cited

U.S. PATENT DOCUMENTS 4,290,336 A 9/1981 Peavey
5,033,351 A 7/1991 Nomura
5,072,643 A 12/1991 Murata
5,911,168 A * 6/1999 Enserink ..... 84/291
6,369,306 B2 * 4/2002 Chapman ..... 84/314 R

* cited by examiner

*Primary Examiner*—Kimberly Lockett
(74) *Attorney, Agent, or Firm*—Baker Botts L.L.P.

(57) ABSTRACT

A molded fretboard according to the present invention has integrally molded frets. The frets are composed of a molded mixture including a higher proportion by volume of glass beads than resin, thereby providing abrasion resistant characteristics that are the same as or better than conventional steel frets. The glass beads are compacted such that each glass bead is in contact with at least one other glass bead. The fretboard itself may be composed of this molded mixture, providing increased abrasion resistance to the top working region of the fretboard, and an entire molded guitar may also be produced in accordance with the invention. A method of installing a fretboard on a guitar is taught which ensures the linearity of the fretboard, regardless of the curvature of the neck. This method provides solutions to the problem of having a bowed neck and the problem of having a non-straight fretboard simultaneously.

23 Claims, 13 Drawing Sheets

MOLDED FRETBOARD AND GUITAR

FIELD OF THE INVENTION

The present invention relates to stringed musical instruments, particularly to guitars, and more specifically to guitar fretboards, including molded guitar fretboards and molded guitars.

BACKGROUND OF THE INVENTION

Most stringed instruments comprise a fingerboard, which is typically a long strip of wood against which strings are pressed during play of the instrument. On many stringed instruments, such as guitars, the fingerboard, or fretboard, is fitted with small metal frets against which the strings are pressed so as to produce different musical notes in 1 increments when the strings are plucked or strummed.

In recent years, some portions of the process of guitar fretboard construction have become automated. However, there is still considerable time and effort required for fitting and assembling the various components of the fretboard, even though the components themselves may be produced in an automated manner.

A top view of a typical conventional fretboard 100 is shown in FIG. 1A. The fretboard 100 typically comprises a straight section of hardwood, often ebony or rosewood. A plurality of slots (not shown in the figure) are cut across the width of the fretboard into which are installed frets 110 (usually consisting of fretwire), which stand above the fretboard surface by about 0.030–0.045". By pressing down on a guitar string between the frets at various positions on the fretboard, the user can produce different musical notes. A typical fretboard length 101 for a guitar is 19". A first fretboard end width 102 for a fretboard length of 19" is typically, 1.7", whereas a second fretboard end width 103 for the same length fretboard is typically 2.1".

The fretboard 100 forms a "musical note scale" defined by a specific distance between each of the frets 110. This specific distance diminishes from left to right in FIG. 1A and requires that the frets must be spaced precise distances apart. The first fret on the left is located a distance (from the left end) of 1/17.8171 of the 'scale length', where the scale length is defined as the total length of the guitar string (typically 25"), set into oscillation. The second fret is set to the right of the first fret at a distance equal to 1/17.817 of the remaining distance (the scale length minus the first fret distance). This pattern of distance spacing continues for the remaining frets, typically 19–24 frets in total depending on the guitar.

The top of fretboard 100 is contoured with a curved or arched-shape, as shown in FIG. 1B, which illustrates an end view of the fretboard 100 of FIG. 1A. This shape is intentionally provided for the comfort of the user while forming bar chords, which require more finger pressure on the fretboard than open chords. A guitar that has its strings set low for ease of chording is termed to have a 'low action' while strings that are set high and require greater pressure for chording are said to have a 'high action'. The radius of curvature used for fretboards typically varies from 7 to 16", but a radius of 12 to 16" may be chosen to suit the average user. A fretboard height 104 for a 19" long fretboard as in FIG. 1 A is typically ¼".

FIG. 1C illustrates a side view of a conventional neck and fretboard assembly. At each fret position on the fretboard 100, the fretwire must be cut to the correct width, and the -edges must be filed to a comfortable shape for a user's hand and fingers. Finally, all of the frets 110 (typically 19 in total) may be filed or sanded to provide a horizontal surface that is level or straight prior to gluing the entire fretboard 100, including the frets 110, to guitar neck 120. Although specific tolerances for the "level" of all the frets of a fretboard are seldom found in the prior art literature, the tolerances appear to range from approximately 0.005–0.010" prior to tensioning the strings the guitar neck 120 may typically comprise a truss rod 130 (shown in dashed lines) inserted therethrough in a cavity along the length of the guitar neck 120 and typically in the center thereof, extending from headstock 140 past heel 150 into the guitar body. The first fretboard end width 102 (see FIG. 1A) is measured at an end of the fretboard located at nut 160, whereas second fretboard end width 103 (see FIG. 1A) is measured at another end of the fretboard located between the heel 150 and a bridge (not shown) over which the guitar strings are passed.

"Steel" fretwire is made of a hard nickel steel alloy, sometimes called "nickel silver". Although the fretwire used in frets is subject to wear by constant string friction during usage, it can last several years before replacement is required. Fretwire replacement and alignment costs for an entire set of frets on a fretboard can be quite costly.

The requirement for high precision in fret construction and placement, together with the high cost of replacing worn frets are some drawbacks of the use of fretwire.

Several known arrangements exist which have attempted to overcome some of the drawbacks inherent with the installation of fretwire on a conventional wooden guitar fretboard. In one such arrangement, a fretboard and frets are machined with a computer milling machine. Such an arrangement, although able to produce a fretboard and frets with shapes and dimensions of high accuracy, is not well suited to the low-cost production of a fretboard and frets, thereby imposing a barrier with respect to its practical use. Other known arrangements employ the concept of having a molded fretboard (and/or molded guitar comprising that molded fretboard) having integral frets, thereby reducing concerns relating to the placement and preparation of frets at particular positions on the fretboard. Examples of patents making reference to a fretboard for a guitar, with the fretboard having integral frets, include: Canadian Patent 1,080,522 issued to Bond on Jul. 1, 1980; U.S. Pat. No. 5,072,643 issued to Murata on Dec. 17, 1991; U.S. Pat. No. 4,290,336 issued to Peavey on Sept. 22, 1981; and U.S. Pat. No. 5,033,351 issued to Nomura on Jul. 23, 1991.

However, there are still drawbacks relating to the above-listed patents. Although some known arrangements, such as those in the Bond patent, appear to discuss the concept of providing integral frets that have good wear characteristics as compared to steel frets, there is little indication as to how these characteristics are specifically obtained. There are references to the use of glass fibers in Murata and a glass-filled neck in Peavey. However, the purpose of the glass fibers, as described in Murata, is to provide strength, and not abrasion-resistance. Peavey does not specifically mention how frets are fabricated, what they are made of, or how they are integrated with the finger board.

The use of glass beads and resin in a musical instrument is taught in U.S. Pat. No. 5,911,168 issued to Enserink on Jun. 8, 1999. However, the glass beads as described in Enserink have a low density and are not used for the purpose of providing strength or preventing abrasion but for the purpose of decreasing overall weight. These glass beads would be buoyant and are not suitable for forming a surface layer on a fretboard. Additionally, the wall thickness of the glass beads is thin (1–3 microns) and is unlikely to provide adequate abrasion resistance, in that the bead wall would most likely collapse under any significant pressure exerted thereon.

Therefore, there is a need for a guitar fretboard that can overcome at least one of the drawbacks of the prior art arrangements.

SUMMARY OF THE INVENTION

The present invention provides a molded fretboard for use with a musical instrument, said fretboard having frets molded integrally herewith, said frets having abrasion resistant characteristics and being composed, in a working region thereof, of a molded mixture including glass beads and resin, said mixture having a higher proportion by volume of glass beads than of resin, and said glass beads being compacted such that each glass bead is in contact with at least one other glass bead.

In the molded fretboard of the present invention, the proportion of glass beads to resin is preferably in the range of about 60:40 to 70:30. Also, the molded fretboard is itself preferably composed substantially of a molding mixture including glass beads and resin, wherein the molding mixture has a higher proportion by volume of glass beads than of resin, whereby the top surface of the fretboard is provided with abrasion resistance.

The glass beads used in the molding mixture are preferably solid glass beads having a diameter in the range of about 1 to 500 microns, with a diameter in the range of about 30 to 150 microns being more preferable. The glass beads are preferably composed of a material selected from the group comprising sodalime, barium titanate, and borosilicate.

The resin used in the molding mixture is preferably composed of one or more materials selected from the group comprising encapsulating epoxy resin, polymer resin, polyester resin, amine-cured epoxy resin, brominated epoxy resin, epoxy novolac resin, bisphenol-A/F based resin, glycidal-based epoxy resin, water-based epoxy resin, casting resin, UV-cured resin, epoxy-polamide combination, and any combination thereof.

Another aspect of the present invention provides a stringed musical instrument comprising a molded fretboard having frets molded integrally therewith, said frets having abrasion resistant characteristics and being composed, in a working region thereof, of a molded mixture including glass beads and resin, said mixture having a higher proportion by volume of glass beads than of resin, and said glass beads being compacted such that each glass bead is in contact with at least one other glass bead.

A further aspect of the present invention provides a process for producing a molded fretboard for use with a stringed musical instrument, comprising the steps of a) pouring a pre-mixed molding mixture of glass beads and resin into a mold plate comprising fret grooves to permit said glass beads to settle into at least the working region of the fret such that each glass bead is in contact with at least one other glass bead, said mixture having a higher proportion by volume of glass beads than of resin; and b) curing the resin to produce a molded fretboard having abrasion resistant frets integrally formed thereon.

It is alternatively possible to perform the process of producing a molded fretboard for use with a stringed musical instrument as above wherein step a) is replaced by the following steps: a1) pouring a molding mixture of glass beads into a mold plate comprising fret grooves, thus creating a glass bead layer in at least the working region of the fret such that each glass bead is in contact with at least one other glass bead, said mixture having a higher proportion by volume of glass beads than of resin; a2) adding a layer of resin on top of the glass bead layer to form an initial thin layer of resin thereon; and a3) allowing the resin to permeate the glass bead layer, without disturbing the beads, so that the resin permeates throughout the entire bead volume including the fret grooves.

The process as defined above may further comprise the step of compressing the glass beads into the fret groove and reducing any air gaps within the fret surface, so as to increase the density per volume of glass beads.

A still further aspect of the present invention provides a method of ensuring the linearity of a fretboard/fingerboard on a stringed musical instrument comprising the steps of: removably attaching one or more linear steel edges to the upper surface of the fretboard to ensure the linearity of the fretboard, regardless of the curvature of the neck; adjusting, with a height adjusting means, the height of the fretboard relative to the neck; injecting an adhesive between the fretboard and the neck; and removing the steel edges once the adhesive is bound.

Another aspect of the present invention provides a method of ensuring the linearity of a neck of a stringed musical instrument comprising the steps of: removably attaching one or more linear steel edges to the upper surface of the fretboard to ensure the linearity of the fretboard; adjusting, with a height adjusting means, the height of the fretboard relative to the neck, to establish linearity of the neck; injecting an adhesive between the fretboard and the neck; and removing the steel edges once the adhesive is bound.

The present invention also provides a fabrication method for ease of manufacturing to be used in order to design a fretboard of unit body construction, including body and frets as one, using resins poured into molds. Such a process would reduce construction time (and costs) considerably and allow a more precise construction of a fretboard to a specific required design shape, which would result in improved playing action. The use of a mixture of resin (or composite resins) and glass beads for fret construction results in frets that have similar, and even better, 'wear' characteristics as compared to the conventional frets used in guitars which are constructed from steel fretwire and are slow to wear from abrasion.

The installation process taught herein comprises attaching the 'straight' fretboard after the neck curvature is set by tensioning of the strings. This method provides solutions to the problem of having a bowed neck and the problem of having a non-straight fretboard simultaneously. As such, a method according to the present invention may be used to ensure the linearity of a fretboard/fingerboard on a stringed musical instrument. A method according to the present invention may also be used to ensure the linearity of a neck of a stringed musical instrument after the strings are tensioned.

Other aspects and features of the present invention will become apparent to those ordinarily skilled in the art upon review of the following description of specific embodiments of the invention, in conjunction with the accompanying figures.

BRIEF DESCRIPTION OF THE DRAWINGS

Embodiments of the present invention will be further described with reference to the accompanying drawings, in which.

DETAILED DESCRIPTION OF THE INVENTION

In the development of the present invention, numerous tests were performed in order to determine the choice of materials and fretboard arrangement to be used in accordance with the present invention. The same electronic and mechanical testing arrangements were employed in order to perform the separate tasks of: measuring fret wear characteristics so as to determine the optimal materials to be used to fill the mold, and of measuring string oscillations so as to determine an optimal curvature for the molded fretboard.

The measurement of string oscillations resulted in a determination that the optimal curvature for the molded fretboard, (once glued to the neck and the strings tensioned), is one that is strictly linear, with no curvature. A discussion of these tests and measurements will be omitted from this description.

Fret wear abrasion test results

The fret heights on any fretboard, regardless of the curvature of the fretboard, will decrease if subjected to wear, which results in a deterioration in sound quality due to buzzing. In specific tests that were conducted (with results extrapolated to normal usage), it was found that conventional steel fretwire would wear at a mean rate (non-linear) of approximately 0.001–0.002" per year (e.g. 1st & 2nd fret at the 1E string position) with an average guitar usage of approximately, 1 hour/day. A total wear of 0.005–0.007" will typically render the guitar sound "poor" and require replacement of fretwire. Consequently, a guitar fretboard might have a practical lifetime of about 7 years. Typically, an acoustic guitar can tolerate a total wear of up to 0;003–0.004" before sound quality deteriorates sufficiently to require fretwire replacement. Although these results were obtained via particular wear tests, they were used in subsequent analysis as a model of standard wear patterns for steel fretwire.

Figure 1A:
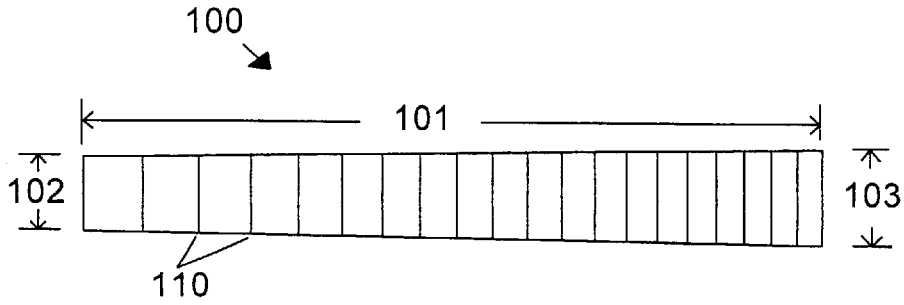
FIG. 1A PRIOR ART
FIG. 1A illustrates a top view of a conventional fretboard.
Figure 1B:
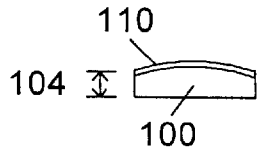
FIG. 1B PRIOR ART
FIG. 1B illustrates an end view of the fretboard shown in FIG. 1A.
Figure 1C:
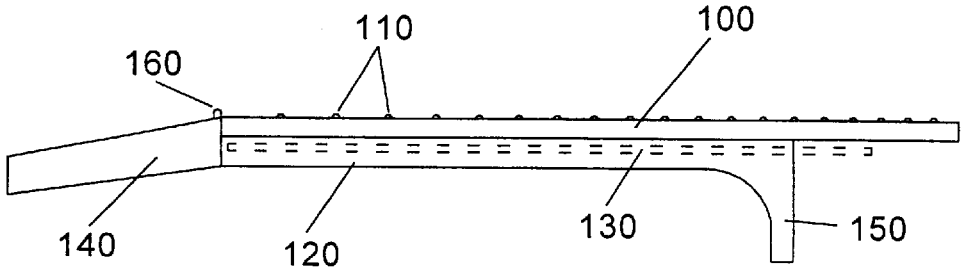
FIG. 1C PRIOR ART
FIG. 1C illustrates a side view of a conventional neck and fretboard assembly.
Figure 2:
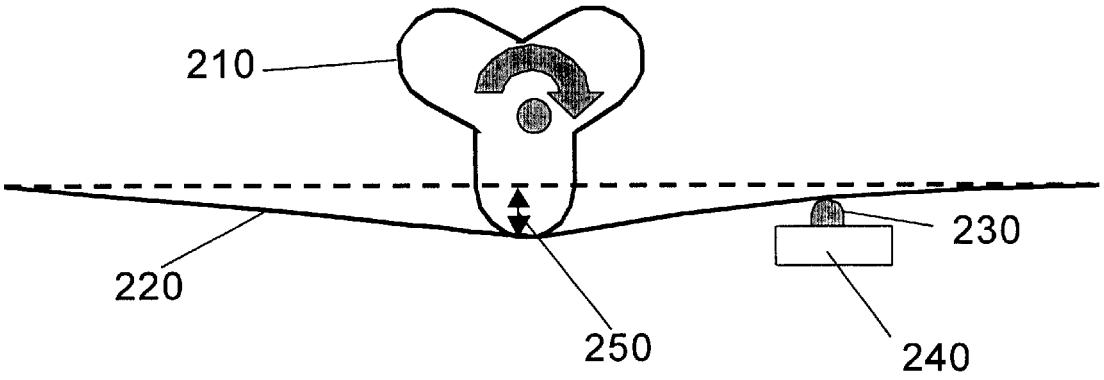
FIG. 2 illustrates a side view of an abrasion tester used to test fret wear of various fret materials.

Frets were tested for abrasion-resistance on an apparatus that was specifically constructed for simulating the impingement of a guitar string on a fret. With reference to FIG. 2, this apparatus consisted of a motorized rotating cam-wheel 210 which would depress a single guitar string 220 onto a test fret 230 (a cross-section of which is shown in FIG. 2) and cause abrasion simulating the depressing action of a player's fingers. The test fret 230 was mounted on a supporting block 240. A treble string of 0.012" diameter was chosen since it typically represents the string (of that approximate diameter) that causes greater wear than other strings of larger diameter. The length of the string (scale length) was chosen at approximately 21" and by tuning it to a treble E note (330 Hz), the string had a tension of approximately 23psi. The total deflection 250 at the cam-wheel 210 was approximately 0.250". The rotating cam-wheel 210 was able to produce 3.3 deflections per second. Although the simulated action of the tester may not be 'exactly' representative of finger pressure and motion, all tests were conducted as being 'relative', that is, by comparing tests of the resin frets against similar tests of steel frets.

Figure 3:
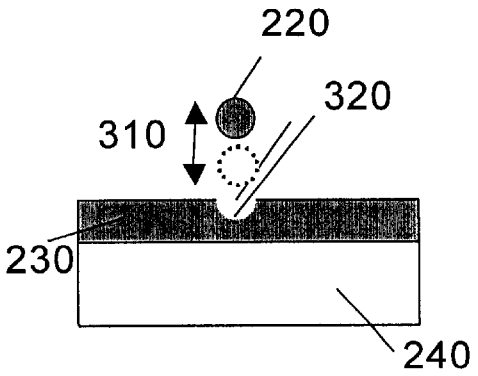
FIG. 3 illustrates a side view of a test fret and a string, and illustrates a vertical compression/abrasion test in accordance with the tester of FIG. 2.
Figure 4:
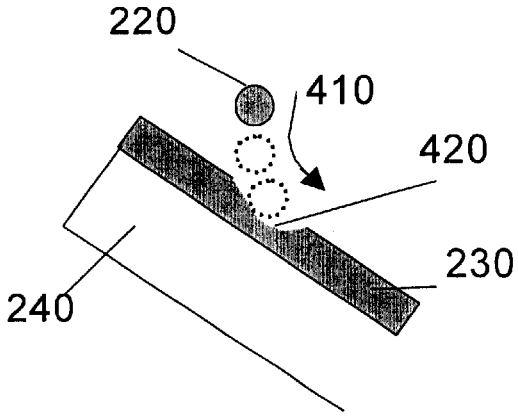
FIG. 4 illustrates a side view of a test fret and a string, and illustrates a sliding abrasion test in accordance with the tester of FIG. 2.

Two types of fret abrasion were simulated and tested. FIG. 3 illustrates a side view of a test fret 230 and a string 220, and illustrates a vertical compression/abrasion test in accordance with the tester of FIG. 2. FIG. 4 illustrates a side view of a test fret 230 and a string 220, and illustrates a sliding abrasion test in accordance with the tester of FIG. 2. For the vertical compression/abrasion simulation, the string 220 followed a string motion path 310 and string impinged at 90° to the fret 230 as shown in FIG. 3 and formed a groove 320 as a result of the forces of compression and abrasion. For the sliding abrasion simulation, the string 220 followed a string motion path 410 and impinged on the fret 230 at an angle of 45°, sliding along the fret 230 for a distance of approx. 0.060–0.125", and formed a wider groove 420 as a result of sliding friction as shown in FIG. 4. In the former case of vertical abrasion, the width of groove 320 was similar to (or slightly larger than) the width of the string 220, which was 0.012" diameter. In the latter case of sliding abrasion simulation, the resulting width of groove 420 was approximately 0.060" as shown in FIG. 4. In all cases the maximum depth of the worn groove was measured microscopically. In each of FIGS. 3 and 4, the dotted circles indicate subsequent positions of the string 220 along the string motion paths 310 and 410, respectively.

Figure 5:
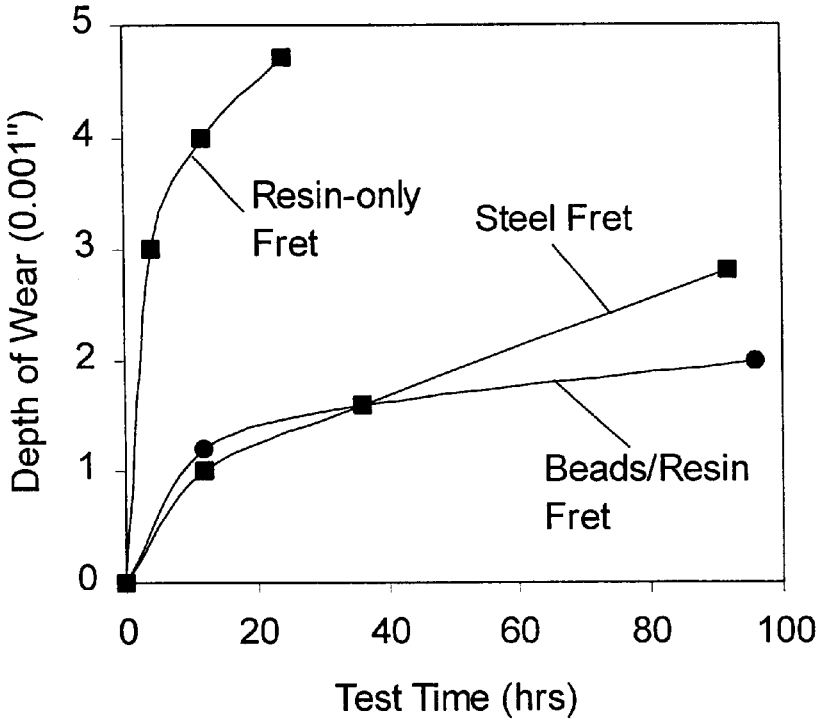
FIG. 5 illustrates recorded wear for vertical abrasion tests of 3 types of test frets.

Three types of frets were tested; i) a reference steel fret mounted on a supporting block, ii) a fret fabricated from epoxy resin-only (no glass beads), and iii) a fret fabricated from compressed glass beads (approximately diameter 80 microns) and bound together by resin. The recorded wear for vertical abrasion of the all frets is shown in FIG. 5, where each fret was tested for 92 hours representing approximately 1 million strokes. As expected for a fret of semicircular cross-section, the wear curve is near-exponential since, as the groove becomes deeper, there is more surface area to abrade. After 92 hours of tests, the steel fret had a wear groove of 0.0028" depth while after 96 hours, the beads/resin fret had a groove depth of 0.0020". The fret fabricated from resin-only had wear of 0.004" after only 12 hours of testing. Comparatively, the frets fabricated from resin-only (ie. a variety of epoxy resins) wore more rapidly than the steel frets by a factor of 4–10X, while the beads/resin fret had similar wear characteristics to that of the steel fret.

Figure 6:
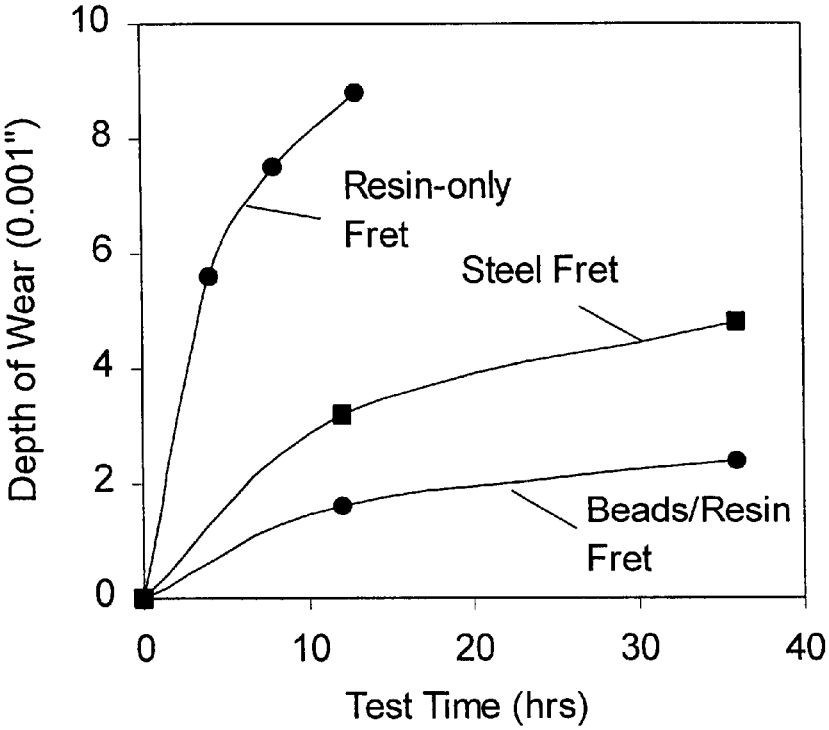
FIG. 6 illustrates recorded wear for sliding abrasion tests of 3 types of test frets.

The recorded wear for sliding abrasion of each of the types of frets is shown in FIG. 6, where each fret was tested for 36 hours representing approximately 400,000 strokes. The resulting curves clearly show that this type of sliding action causes greater wear to a fret than that of vertical compression/abrasion. After 36 hours of tests, the steel fret had a maximum wear depth of 0.0048" while the beads/resin fret had a maximum wear depth of only 0.0024". The resin-only fret had a wear depth of 0.0088" after only 12 hours of testing or approximately 3X that of the steel fret. The beads/resin fret typically showed 1.5–2X less wear than that of steel frets demonstrating the suitability of this improved design.

Following the conclusion of many similar tests, it was found that most epoxy resins/plastics would wear approximately 3–10 times faster than steel fretwire, with up to ⅔ of the wear potentially occurring during the first ⅓ of its usage. Although easily manufactured, the use of these resins/plastics would not be practical since the frets would require replacement in 6 months. One of the most durable resins, polyester resin, known for its 'hardness' (it is used to coat piano surfaces), was tested. This polyester resin was found to wear 3 times faster than conventional steel fretwire. Its use would still be impractical since frets made of polyester resin would require replacement within 1 year. Moreover the fret of polyester resin was also brittle and therefore is easily chipped or shattered on impact, further rendering it impractical as a fret material.

As a result of these studies, it was determined that resins/plastics are not suitable as fret materials due to their poor abrasion-resistance characteristics, which would explain why these materials are not seen on commercial guitars. Furthermore, it would not be practical to mold integrally a plastic fret in a fretboard since the frequency of replacement would require replacement of the entire fretboard and not just the frets. An example of an ideal abrasion-resistant fret would be one that is made of glass. However, glass frets would be also be difficult to manufacture and install, and would be brittle and susceptible to chipping and breakage. As can be concluded from the above data, the fret with a mixture of glass beads and resin was found to provide the best wear characteristics of those materials tested. Following this result, it remained to be determined what particular materials could preferably be used for this mixture, as well suitable methods of preparing and pouring the mixture.

Choice of Mold Resins and Preparation

There were two main criteria for the fret design; i) the fret should be formed from poured resins allowing precise control of shape, spacing and height, and ii) the frets should provide better or at least (near-) equal abrasion-resistance when compared to conventional steel guitar frets. Also, the material chosen for use in the frets and the fretboard surface had to provide resistance to abrasion from the constant pressure and movement of strings on top of the frets. Several epoxy resins were tested and found to be suitable for forming poured frets and each of the resins was found to provide certain beneficial properties in forming frets. Some specific beneficial properties were: i) hardness and resistance to surface scratching, ii) resistance to shrinkage during the curing process, iii) rapid curing time, iv) finish quality, and v) breakage resistance. Some specific suitable resins used in this fabrication process were i) Resin A- an encapsulating epoxy resin (such as SEALTRONICS™), ii) Resin B- a polymer resin (such as ENVIROTEX™), and iii) Resin C- a polyester resin (such as RESLACK™).

Resin A had an approximate working time of 1 hour once activated and an approximate cure time of 24 hours at room temperature. Resin B had a working time of 30–40 minutes and a cure time of approximately 24 hours. Resin C had a working time of 15–30 minutes and a cure time of 24 hours. Both Resins A and B were separately used to form the surface of the fretboard. In a preferred embodiment, the use of resin A (SEALTRONICS) for the frets and fretboard surface provides excellent properties of resiliency and resistance to chipping. Many other epoxy resins having similar characteristics are also suitable for the fabrication process such as, for example: amine-cured epoxy resins, brominated epoxy resins, epoxy novolac resins, bisphenol-A/F based resins, glycidal-based epoxy resins, water-based epoxy resins, casting resins, UV-cured resins, epoxy-polamide combinations, and polyester resins (eg. Ortho, isophthalic, vinyl ester).

Fabrication process

Resin frets fabricated in accordance with a preferred embodiment of the present invention are fabricated from a molding mixture consisting of small solid glass beads (for example, 80 microns diameter) bound together by epoxy resin. Frets fabricated of poured resin alone were found to have poor wear characteristics compared to steel. Ideally, a fret fabricated from solid glass would provide superior wear characteristics to those of steel; however, glass would also be brittle and susceptible to chipping and breakage. Moreover, fret fabrication would require using molten glass at high temperatures in the mold process. Therefore, the molded mixture of glass beads and resin combines to offer the superior wear characteristics of glass and the ease of fabrication of resin.

The fabrication process will be described in general terms below, with a more detailed description to follow. By first filling fret grooves in a mold plate with solid glass beads of small diameter (for example, 80 microns), the beads take the form of the fret itself. An epoxy resin is then poured onto the glass beads. Once permeated with epoxy resin, the beads are held together in a solid form of a fret possessing properties of excellent wear characteristics and high resistance to breakage.

The glass beads used in fabricating the frets may be of a uniform diameter or a mixture of diameters. The bead diameters may range from 1–500 microns and may be preferably of a diameter of about 30–150 microns. Bead diameters less than 80 microns result in a smoother fret surface but also involve a more difficult fabrication and handling process. The glass is preferably selected from the group comprising: sodalime, barium titanate, and borosilicate. The term "glass" is used herein as a general term for non crystalline solids with compositions comparable to crystalline ceramics. For example, borosilicate may be composed of approximately 76% silica ($SiO_2$) by weight, with the balance of the material being primarily boron oxide ($B_2O_3$), as well as aluminum oxide ($Al_2O_3$), sodium oxide ($Na_2O$) and a small proportion of calcium oxide (CaO).

The glass beads are preferably spherical in shape, but may alternatively be a variety of non-spherical or ellipsoidal shapes. Other shapes may also be used with somewhat of a reduction in the advantageous properties of the spherical or quasi-spherical (approximately ellipsoidal) glass beads. The beads may alternatively be comprised of materials other than glass (e.g. steel, ceramics, etc.) provided these materials possess adequate abrasion-resistance properties. While the use of solid glass beads is preferred, hollow glass beads may alternatively be used, although the hollow beads will not provide the same degree of abrasion resistance, due to their more delicate constitution.

Figure 7A:
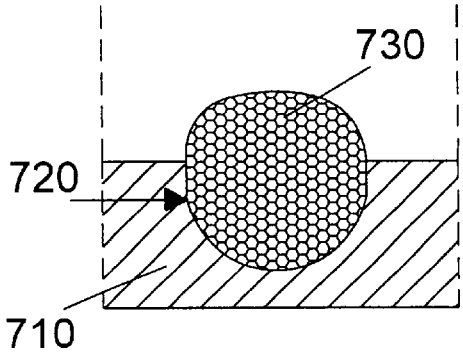
FIG. 7A illustrates diagrammatically a side cross-sectional view of a fret groove for illustrating a process of forming a fret (and fretboard) according to an embodiment of the present invention.

A fabrication process in accordance with an embodiment of the present invention will now be described in further detail with reference to FIGS. 7A–7D, which each illustrate diagrammatically a side cross-sectional view of a mold plate 710 and a fret groove 720. In FIG. 7A, glass beads 730 of approximately 80 microns in diameter, for example, are poured into the fret groove 720 such that the mound, or layer, of beads 730 protrudes above the surface of the mold plate 710. This protruding layer of glass beads 730 may be of a thickness of approximately 0.60"–0.125". Commercially available beads are usually sold as being within a certain tolerance from the desired size. Therefore, beads sold as being 80 microns may, in fact, range from about 65 microns to about 95 microns.

Figure 7B:
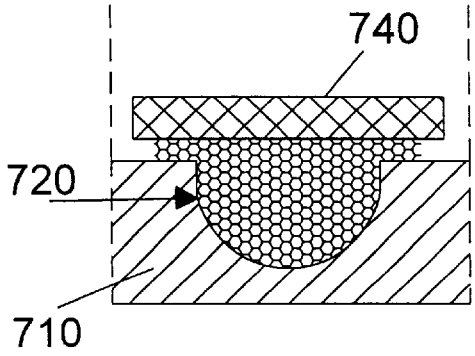
FIG. 7B illustrates an optional compression step in the process of forming a fret according to an embodiment of the present invention.

In an optional but preferable step illustrated in FIG. 7B, a compressing means 740, such as a flat plate, is pressed down upon the bead mound compressing it into the fret groove 720. There are two main reasons for compression of the beads. The first is to ensure any air gaps within the fret surface are completely filled with beads. Secondly, since many of the beads may not be exactly spherical but approximately ellipsoidal, compression reduces air spaces between all the beads resulting in maximum density of beads per volume.

Figure 7C:
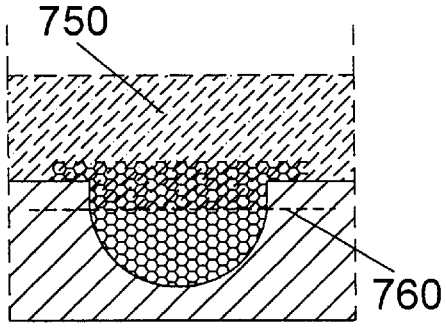
FIG. 7C illustrates the partial permeation of a glass bead layer by a thin layer of resin in the process of forming a fret according to an embodiment of the present invention.
Figure 7D:
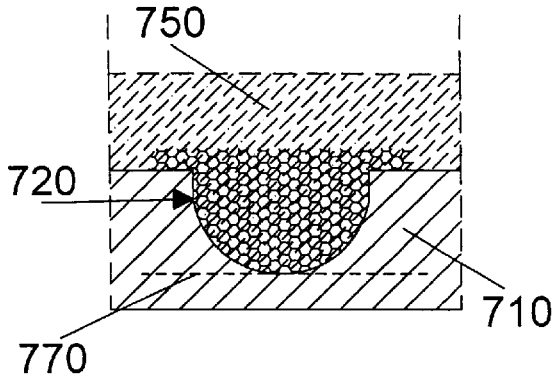
FIG. 7D illustrates the full permeation of resin throughout a glass bead layer in the process of forming a fret according to an embodiment of the present invention.

The mold is then filled by pouring an appropriate resin 750 as shown in FIG. 7C, where the resin 750 is seen to have partially permeated throughout the beads until a level 760. In the case of performing compression as in FIG. 7B, the resin 750 is poured after the compressing means 740 has been removed. Over a period of approximately 15–30 minutes (the exact length of time being temperature dependent), the resin 750 permeates throughout all the beads within the fret groove to the bottom 770 of the fret groove 720, as illustrated in FIG. 7D. The resin 750 effectively permeates into all the air spacings between the beads 730, which are compressed and in contact, and serves to bind the beads together keeping the exact shape of the fret groove. In the examples shown in FIGS. 7A–7D, an encapsulating epoxy resin is preferably used, typically having a cure time of approximately 24 hours at room temperature (70° F.). The resin temperature may be raised to approximately 90° F. using a heat lamp, or another appropriate means, thereby reducing the cure time and ensuring complete permeation throughout the beads.

The compression of beads as shown in FIG. 7B and the full permeation of resin as shown in FIG. 7D result in a fret with the desired improved wear characteristics. When compression is used, the ratio of beads to resin in the molded mixture is typically approximately 70:30 and provides an abrasion-resistance of typically about 1.5–2.0X better than that of steel frets. By simply pouring beads 730 into the fret grooves 720 as shown in FIG. 7A and leaving the beads uncompressed, a fret can also be fabricated following the pouring and permeation of the resin 750. The resultant bead to resin ratio of the uncompressed beads is typically approximately 65:35. In this uncompressed bead configuration, the abrasion-resistance of the resulting fret is typically about 1.3–1.5X better than that of steel frets or slightly less than that of the compressed bead configuration. A range of beads to resin ratio for the molded mixture may be used to fabricate frets, and this may vary such that the composition of beads may vary from about 50–70%. Increasing the bead composition above 70% will improve the wear characteristics of the fret composed of the molded mixture of beads and resin and this may be achieved by compression of a variety of bead shapes or geometries. However, the advantages of the present invention are present as long as the molded mixture comprises a higher proportion of glass beads than of resin.

Although the use of only one resin represents a simpler process for production, it was found to sometimes result in some compromise in desired physical properties. Therefore, a slightly more complex alternative was pursued which reduces the compromise in desired physical properties when using only one resin.

Figure 8:
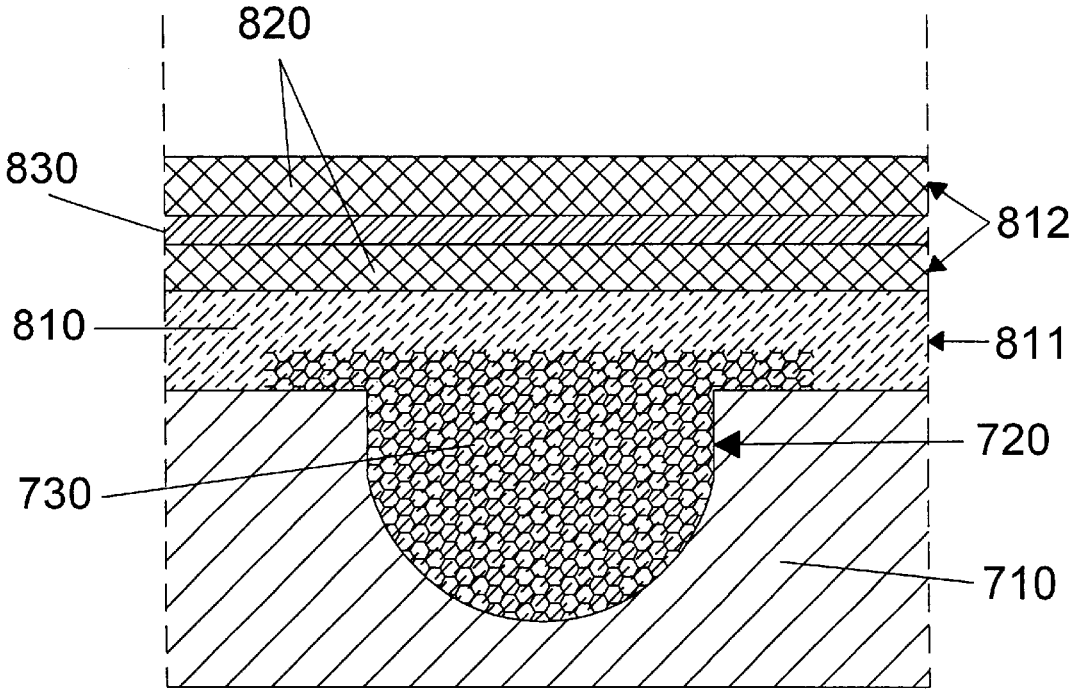
FIG. 8 illustrates an alternative embodiment with respect to a method of fret (and fretboard) fabrication, wherein two layers of resin may be poured.

FIG. 8 illustrates an alternative embodiment with respect to a method of fret (and fretboard) fabrication, wherein two layers of resin 810 and 820 may be poured to form the frets and/or fretboard. The two layers of resin 810 and 820 that are poured may be used to provide different properties. Resin 810, for example Resin A, once poured and cured may provide the properties of resilience to marring or chipping. Resin 820, for example Resin C, may provide properties of rigidity and strength. The thickness-of either layer may be adjusted to enhance one or the other property. In addition, within either the single resin layer fretboard shown in FIGS. 7A–7D or the two-layer fretboard of FIG. 8, an aluminum (Al) plate 830 (e.g., 1/32" or 1/16" thickness) may be embedded in either layer of resin providing greater fretboard rigidity.

FIG. 8 illustrates an end view of the mold body 710 with fret groove 720 as used in accordance with the alternative embodiment of a method of fabrication. Resin 810 is first prepared. A colorant may preferably be added for aesthetic purposes. The colorant can be of any desired concentration, for example 4%. The first layer 811 of resin 810 (preferably one of Resin A or Resin B) is poured, preferably in amounts of approximately 20 ml, forming a layer of approximately 1/16" (note that the heights are exaggerated for demonstration purposes). Prior to the step of pouring the resin 810, a release agent, such as a wax, may be applied to the mold body 710 to assist in the eventual release of the cured resin. The resin 810 then permeates throughout the entire glass bead layer (without disturbing their positions). The fine. glass beads 730 essentially form the entire fret shape while bound together by resin. Moreover the glass beads 730 also form a 1/16" fretboard surface while also bound together by resin. Following the appropriate cure time (typically several hours under a heat lamp), an aluminum plate 830 (preferably approximately 17"×1.5"×1/32" —perforated with 1/4" drilled holes) is placed above and parallel to the first layer, 811, elevated above the surface of the layer 811 by about 1/16" by elevating means (not shown) to allow for subsequently poured resin to settle below the aluminum plate 830. The plate 830 provides extra rigidity in the fretboard with minimal weight. A second layer 812 of resin 820 is then poured on top of layer 811, after an appropriate waiting period, which is preferably the cure time of resin 810. This resin 820 was chosen for its higher tensile strength, low shrinkage during curing and, coupled with the aluminum plate 830, would provide strength and rigidity to the fretboard. In a preferred embodiment, resin 820 is Resin C, consisting of an admixture of about 40–50 ml. of resin, 1–2% (by volume) activator and 1–2% (by volume) accelerator, which was prepared with an admixture of 4% colorant, 50% glass beads (preferably approximately 80 microns in diameter) and poured as a second layer. The cure time was approximately 24 hours, at which time the resulting molded fretboard was released or lifted from the mold.

It is to be understood that the examples above are non-limiting examples and that there are a number of other resin combinations, and single resins, that may alternatively be used.

There are some factors that may potentially reduce the wear characteristics of the fret composition according to the present invention. For instance, an increase in ambient temperature can result in some resins becoming softer and may result in a reduction of wear characteristics. Also, the use of strings made of materials other than steel and bronze alloy may possess differing frictional characteristics also reducing the frets abrasion-resistance characteristics. Overall, while encompassing a wide range of operating conditions, the beads/resin molded mixture fret possesses similar wear characteristics or improved (approx. 1.5–2×) wear characteristics in comparison to conventional steel frets.

Producing a composite of glass beads and resin would result in frets and fretboard surface that was resistant to abrasion and wear by virtue of the strings sliding along essentially a 'glass' surface. Tests lasting approximately 96 hours using the abrasion tester of FIG. 2 proved that this glass bead fret had approximately 1.5–2X greater abrasion-resistant characteristics than that of the conventional steel fretwire. The fretboard surface also provided a glass bead surface (bound by resin) resistant to abrasion. Although there was no quantification in this study, the fine glass bead surface would have a much higher abrasion resistance than that of conventional hardwood, such as ebony. Finally the overall fretboard being constructed of a resin/glass bead composite had a higher density of 1.6X that of ebony and hence improved properties of sound transmission to the neck & body. The overall weight of the composite fretboard was similar to that of an ebony fretboard since it had a substantially thinner profile.

To summarize, a process according to an embodiment of the present invention for producing a molded fretboard for use with a stringed musical instrument has been described, the process comprising the steps of: pouring a molding mixture of glass beads into a mold plate comprising fret grooves, thus creating a glass bead layer in at least the working region of the fret such that each glass bead is in contact with at least one other glass bead, said mixture having a higher proportion by volume of glass beads than of resin; adding a layer of resin on top of the glass bead layer to form an initial thin layer of resin thereon; allowing the resin to permeate the glass bead layer, without disturbing the beads, so that the resin permeates throughout the entire bead volume including the fret grooves; and curing the resin whereby to produce a molded fretboard having abrasion resistant frets integrally formed thereon.

In an alternative embodiment, the first three steps of this process may be replaced by the single step of pouring a pre-mixed molding mixture of glass beads and resin into a mold plate comprising fret grooves, whereby said glass beads settle into at least the working region of the fret such that each glass bead is in contact with at least one other glass bead, said mixture having a higher proportion by volume of glass beads than of resin. The pre-mixing of the molding mixture could potentially save time and allow for this step to be performed by another party such that one wishing to produce a molded fretboard according to the present invention could simply purchase a pre-mixed molding mixture.

Construction of the Fretboard

The fretboard including frets was formed from poured resins in a mold. The fretboard surface was formed using a mold plate 900 shown in FIG. 9A. The plate material must be able to release the resin form once cured and these materials could be either acrylic, polycarbonate (LEXAN™) or polypropylene (preferred). Fret grooves 910 are milled within the mold plate 900. Length 901 of the plate 900 used in this specific embodiment was 19". First fret width 902 in this specific embodiment was 2.1", while last fret width 903 was 1.75".

Figure 9A:
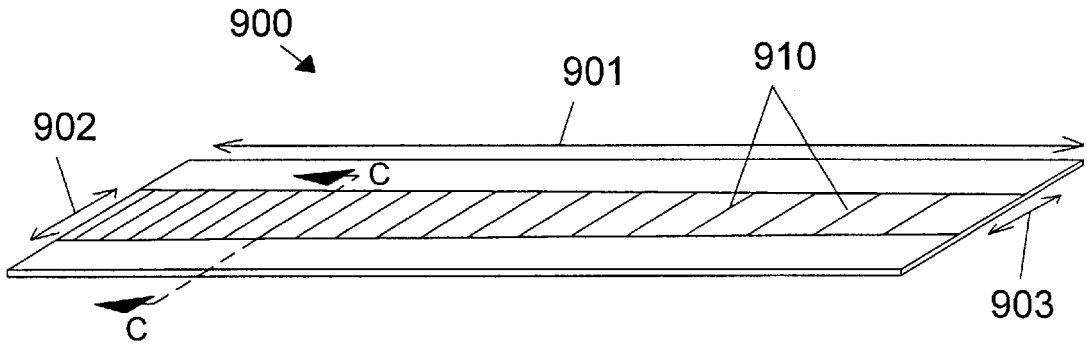
FIG. 9A illustrates a perspective view of the top of a mold plate in which resins are poured to construct a molded fretboard in accordance with an embodiment of the present invention.
Figure 9B:
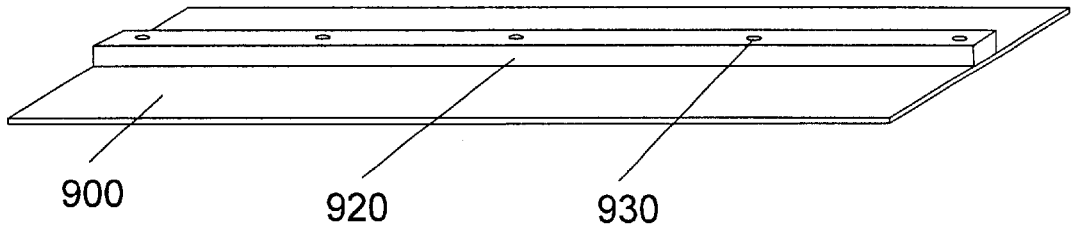
FIG. 9B illustrates a perspective view of the bottom of the mold plate of FIG. 9A.

The mold plate 900 was then placed face down on a level (<0.001") surface as shown in FIG. 9B, which illustrates a perspective view of the bottom of the mold plate of FIG. 9A. A 3/8" square steel bar 920 preferably having threaded holes 930 thereon was then glued along the center line of the polypropylene mold plate 910. Under tension, the steel bar 920 was used to maintain (or alter) linearity in the plate's surface.

Figure 9C:
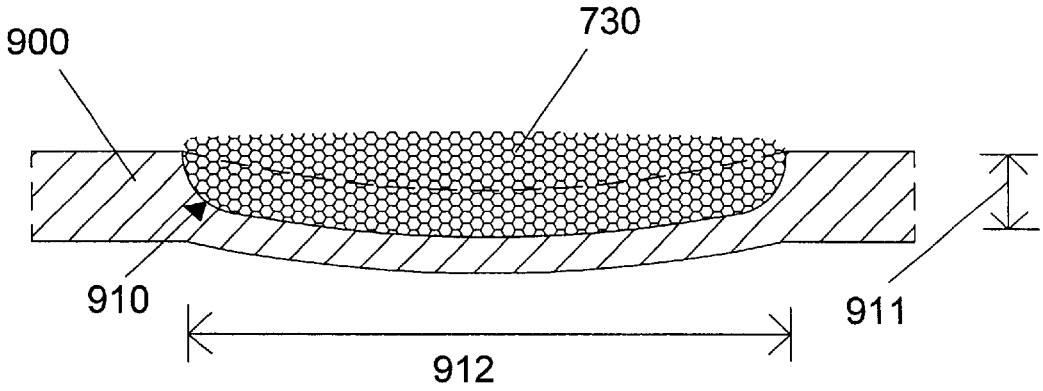
FIG. 9C illustrates diagrammatically a cross-sectional view taken along line C—C of FIG. 9A.

FIG. 9C illustrates diagrammatically a cross-sectional view taken along line C—C of FIG. 9A, showing fret groove 910 in the mold plate 900 of FIG. 9A filled with glass beads 730. In a preferred embodiment, the fret grooves 910 were milled at a fret groove depth 911 of about 0.032" using a 3/32" ball mill. The fret groove widths 912 range from about 1.75–2.1" (increasing from left to right in FIG. 9A) and are spaced according to the scale rule of 1/17.8171 using a scale length of 25". Tolerances used in this specific embodiment were <0.001".

Figure 10A:
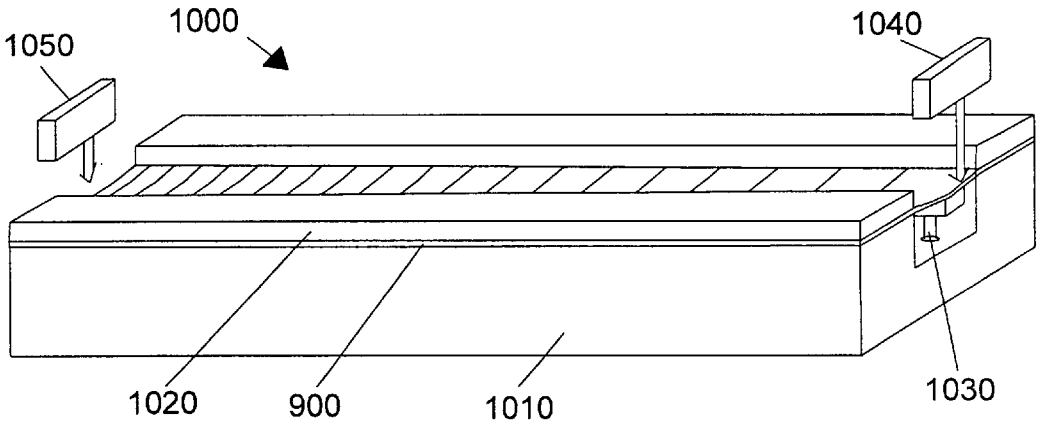
FIG. 10A illustrates a perspective view of a mold body in which a mold plate is used in accordance with an embodiment of the present invention.

A completed mold body 1000 is shown in FIG. 10A. The mold plate 900 was placed on a level (<0.001") mold base 1010, which is preferably composed of polyvinyl chloride (PVC). The mold plate 900 was held flat, under pressure and in position on the mold base 1010 by two strips 1020 (preferably composed of LEXAN or polypropylene 3/8" thick) which are placed on top and affixed to the mold base 1010. The inside edges of the strips 1020 were aligned with the outside edges of the fret grooves 910 on the mold plate 900 and formed the boundary walls used to contain the resin when poured. Height adjusting means 1030, which are height adjust screws in this embodiment, were used to provide downward tension on the plate resulting in a slight curvature or radius. A guitar nut with 6 grooves 1040 was placed at the narrow end and attached to the ends with silicone. A blank plate may alternatively be provided as element 1040. At the opposite end was placed a blank polypropylene plate 1050 attached and sealed with silicone. The result is a sealed channel used to contain the poured resins.

Figure 10B:
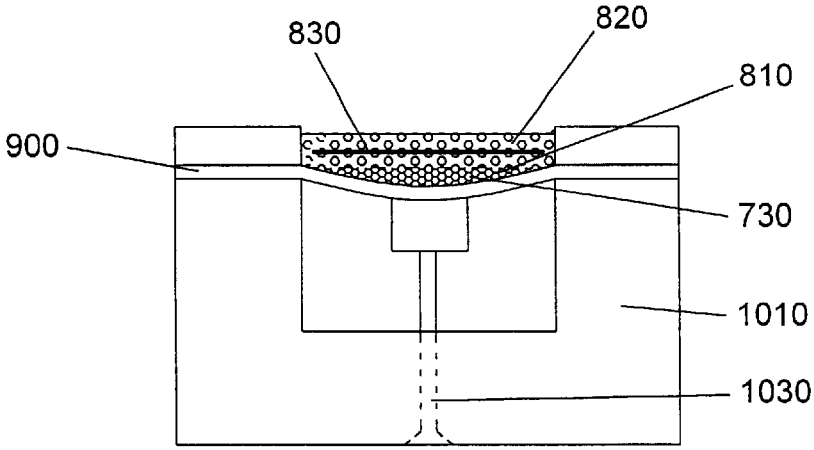
FIG. 10B illustrates diagrammatically an end view of the mold body of FIG. 10A filled with glass beads and resin.

FIG. 10B illustrates an end view of FIG. 10A. Note that curvature heights are exaggerated for demonstration purposes. FIG. 10B also illustrates the mold body 1000 being filled with glass beads 730, as well as with layers of resins 810 and 820. By lowering the entire mold plate by 0.026", a compound radius of approximately 16" was obtained along the entire length of the mold plate.

Figure 11:
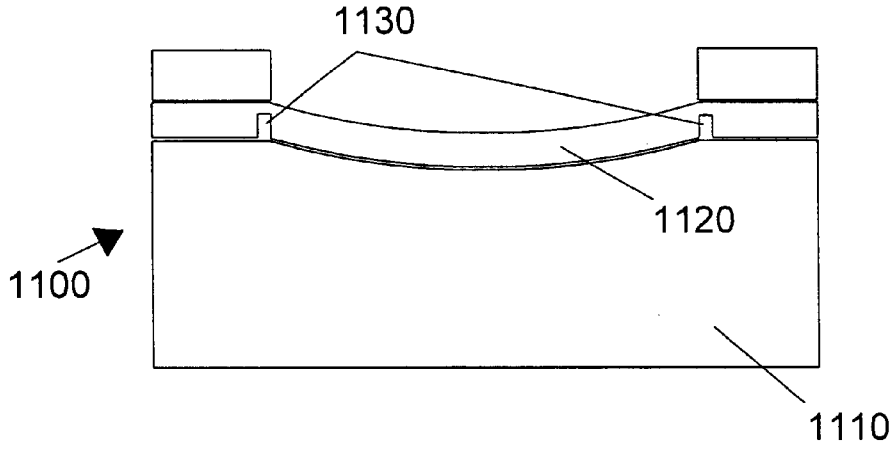
FIG. 11 illustrates an end view of an alternate embodiment of a mold body, which may be used instead of the mold body FIG. 10A.

FIG. 11 illustrates an end view of an alternate embodiment of a mold body 1100, which may be used instead of the mold body 1000 of FIG. 10A. A mold plate 1120 (preferably composed of polypropylene) with milled fret grooves (not shown) is glued directly to a mold base 1110 (preferably composed of PVC or aluminum) having a milled surface comprising a longitudinal 16" radius. The attached mold plate 1120 assumes the radius of curvature of the mold base 1110. A pair of longitudinal slots 1130 are milled in the bottom providing the plate 1120 freedom to bend at the edges. A configuration such as the one in FIG. 11 accomplishes a similar effect as the mold body 1000 shown in FIG. 10A while using simpler fabrication methods for the overall assembly.

The fretboard surface itself is also subjected to string wear, but over a larger surface area. High-density wood is normally used for fretboards and will also wear significantly over a similar period of time as the frets. Therefore, in another embodiment of the present invention, a glass bead layer is also used for the fretboard surface as shown in FIG. 9 where a surface bead layer covers the mold plate and the poured resin has permeated throughout. In such an embodiment, the wear characteristics are also improved significantly.

Installation of Fretboard

Figure 12A:
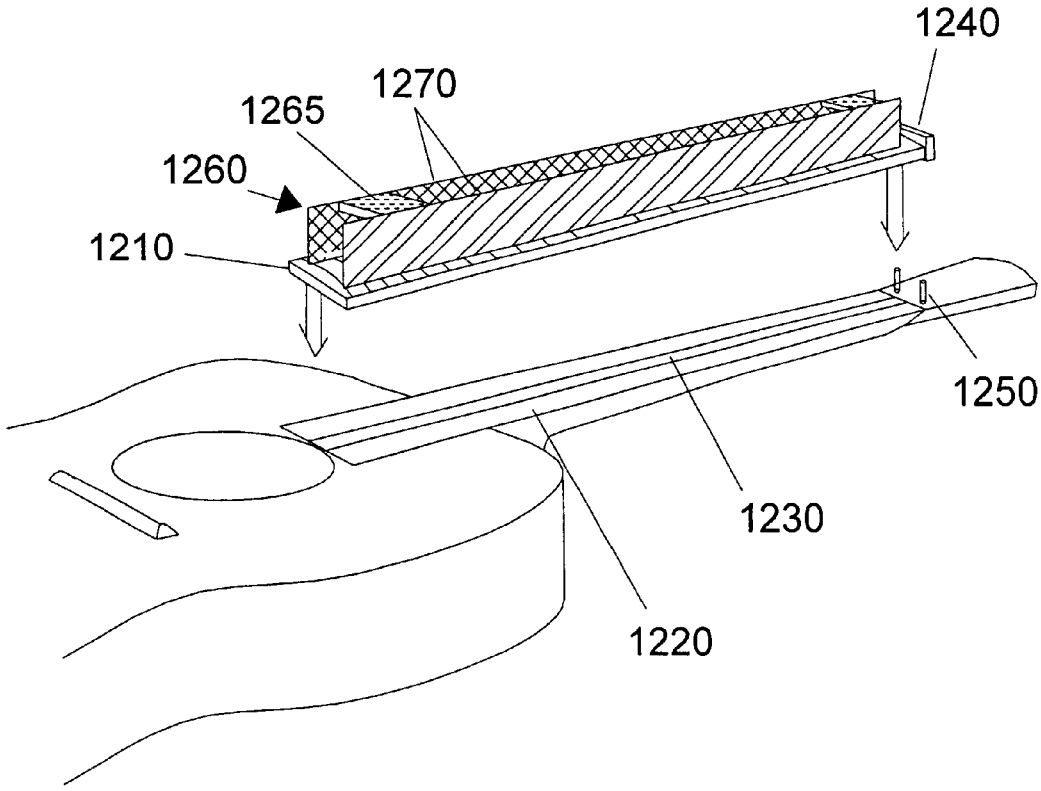
FIG. 12A illustrates materials used in a fretboard installation process according to an embodiment of the present invention.
Figure 12B:
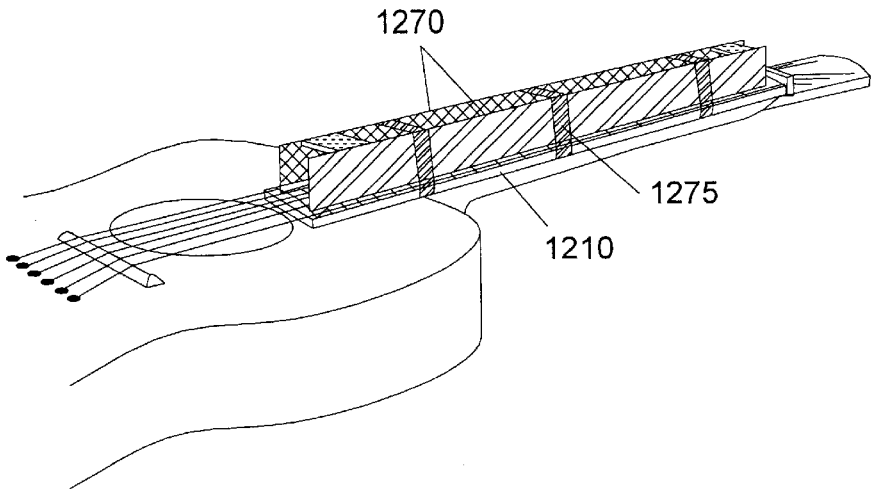
FIG. 12B illustrates another configuration according to the installation process described in relation to FIG. 12A.

FIGS. 12A and 12B illustrate material to be used in the installation of a fretboard according to an embodiment of the present invention. The installation process described below is preferably used with a molded fretboard according to an embodiment of the present invention, but may alternatively be used with a conventional wooden fretboard, as will be described later. With reference to FIG. 12A, in the case of the installation of a new fretboard 1210, a bare neck surface 1220 of a guitar and a channel 1230 containing the truss rod are already exposed. (In the case of replacing an existing fretboard, the existing fretboard will have to be removed in order to expose the bare neck surface 1220 and the channel 1230 containing the truss rod.) Holes, for example of about 1/8" diameter, are drilled in the neck 1220 and in the nut 1240 of the molded fretboard 1210. Locating pins 1250 are preferably placed in the neck 1220. Mounting the nut 1240 (with the fretboard 1210 attached thereto) on the locating pins 1250 would fix the scale length of the guitar and keep the position of the nut 1240 fixed while adjustments were made and strings placed under tension. Alternatively, the nut 1240 is separate from the molded fretboard 1210. In such a case, the nut 1240 is mounted on the locating pins 1250, whereas the molded fretboard 1210 is installed separately, as will be described below.

The process of installing the new fretboard begins by i) installing all 6 strings (in this example, light 80/20 bronze strings-total tension 159 lbs) under tension by tuning to correct frequencies, and ii) tightening the truss rod until the neck was restored to the straightest position possible, although some curvature may remain. Although the fretboard 1210 is typically fabricated with a specific shape (i.e. straight), it usually has very slight flexibility. To ensure that the fretboard 1210 would be installed in a perfectly 'straight' position on the neck, a rigid body 1260 will be removably attached to the fretboard 1210 to maintain rigidity during installation. In a preferred embodiment, the rigid body 1260 comprises one or more (preferably two) straight (level <0.001") steel edge plates 1270 as well as at least one suitable rigid spacer 1265 to provide structural rigidity and ensure appropriate spacing between the steel edge plates 1270 along the length of the fretboard.

With reference to FIG. 12B, the molded fretboard 1210 is then placed under the strings nearest the bridge. The bottom side of the steel edge plates 1270 is placed in contact with the fretboard 1210 between the tensioned strings. The top of each steel edge plate 1270 is removably secured to the fretboard. In the example illustrated in FIG. 12B, a securing means 1275 is used to removably secure the steel edges 1270 of the rigid body 1260 to the outside edges of the fretboard 1210. In FIG. 12B, the securing means 1275 used is vinyl tape. Note that the vinyl tape removably attaches the steel edges 1270 to the fretboard 1210 to ensure the linearity thereof; the vinyl tape is not secured to the neck 1220.

Figure 12C:
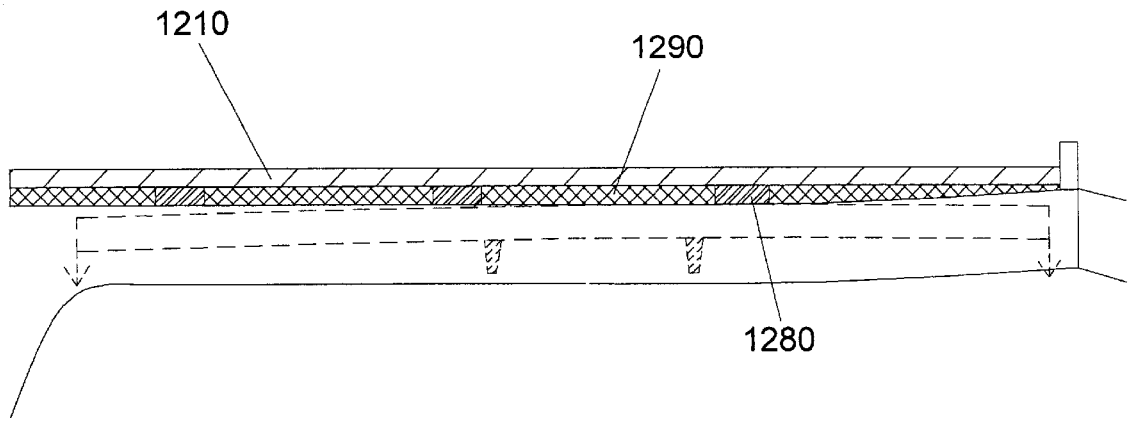
FIG. 12C illustrates a cross-sectional view of the installation process described in relation to FIGS. 12A and 12B.

With reference to FIG. 12C, the assembly comprising the fretboard 1210 with nut 1240 integral therewith has been placed on the surface of the neck, with the strings already being tensioned and the fretboard being rendered straight, as described in relation to FIG. 12B. The separation between the strings and tops of the frets (at frets 1 & 12) is adjusted to ideal distances (as close as possible) by using a height adjusting means 1280. The height adjusting means 1280 may be selected from the group consisting of: a shim and an adjusting screw. In the case of a shim, the method comprises inserting appropriate shims between the fretboard and neck. In the case of an adjusting screw, the method comprises performing an appropriate adjustment to obtain the desired distance. Of course, other adjusting means may alternatively be used while providing the same outcome. Once the separation between the strings and tops of the frets has been adjusted to the desired distances using the height adjusting means 1280, an appropriate adhesive 1290 is inserted between the fretboard and the neck.

In the case of the fretboard 1210 and the nut 1240 being separate, although the nut 1240 is secure since it is mounted on locating pins 1250, the fretboard 1210 is not secure when it is placed on the surface of the neck. The height adjusting means 1280 are used, as described above, to adjust to the desired height. However, since the fretboard and the rigid body 1260 are not secured to the neck, they may be moved towards the bridge, allowing for adhesive 1290 to be easily inserted in an exposed area between the nut and the first fret. Then, the adhesive 1290 is preferably inserted along the length of the neck, as shown in FIG. 12C. The assembly consisting of the fretboard 1210 and the rigid body 1260 comprising the steel edge plates 1270 is then moved up to the nut and placed on the neck, thereby compressing the adhesive 1280 and leaving a separation gap of approximately 1/16".

Once the adhesive 1280 has dried, the steel edges 1270 are removed, leaving a straight molded fretboard attached to and suspended on an uneven neck under tension from its strings. Provided that the strings maintain constant tension, the molded fretboard should retain its correct (linear) curvature. Any suitable filler material may optionally be used at this point to fill in any gaps before preparing the guitar to be finished, polished and otherwise rendered esthetically pleasing as a finished product.

In tests of the present invention, a molded fretboard was constructed, installed and tested for acoustic guitars using the criteria described in the previous section. Two guitars were modified, a 30 year old steel string acoustic guitar (brandname DANA™) and a new steel string acoustic guitar (brandname Yamaha™F-310). The existing wood fretboard of the DANA guitar was replaced with one made from resins.

Figure 13:
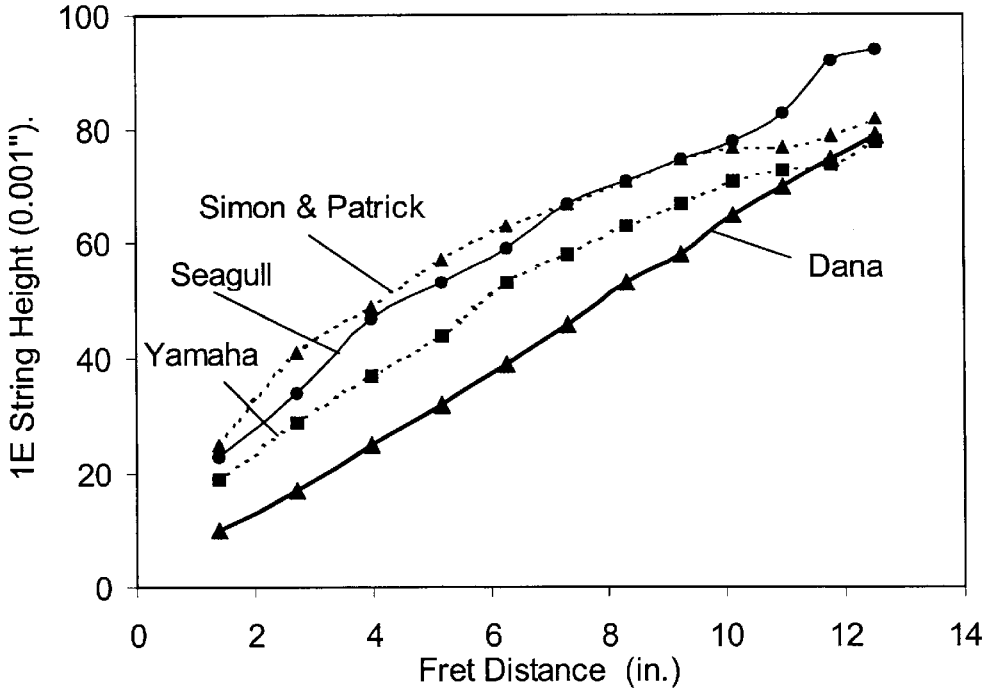
FIG. 13 illustrates a first set of string height characteristics of a molded fretboard according to the present invention in comparison to 3 conventional guitars.
Figure 14:
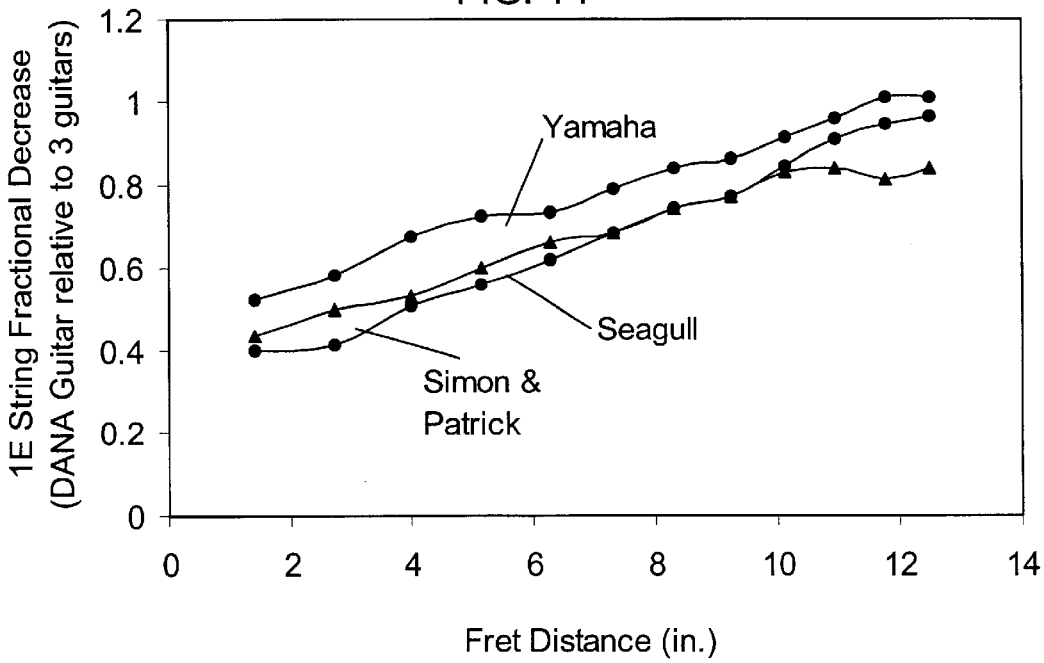
FIG. 14 illustrates a fractional decrease or improvement of the guitar with the molded fretboard according to the present invention relative to the conventional guitars as compared in FIG. 13.

Characteristics of the Molded Fretboard and Comparison to Conventional Guitars A molded fretboard according to an embodiment of the present invention as described above was installed on the DANA guitar. The string heights were set by adjusting the bridge heights using shims. The string heights were set to a minimum height by minimizing string buzz at a sound level which would be considered (subjectively) 'medium' action and permitted reasonably 'hard'playing of the strings. The heights of the strings above frets 1–12 were measured and compared to 3 conventional guitars; Yamaha™FS-311, Seagull™S(6) and a Simon & Patrick™. The string heights measurements (1E treble string) are presented in FIG. 13. The DANA guitar clearly indicates the string heights to be linear over the entire fretboard with a precision of 0.001" with string heights ranging from 0.010–0.079" at fret 1 and fret 12 respectively. The conventional guitars show higher string heights overall but in 2 cases (Yamaha & Simon/Patrick) the string heights converge at fret 12. FIG. 14 shows the fractional decrease or improvement gained with the new fretboard. The largest improvements in string heights occurs at the lower frets #1–5 where the average fractional decrease in string heights was 0.4–0.5 thereby resulting in an improvement of approximately 2X. The string heights at fret #12 remained constant and no gains were realized.

Figure 15:
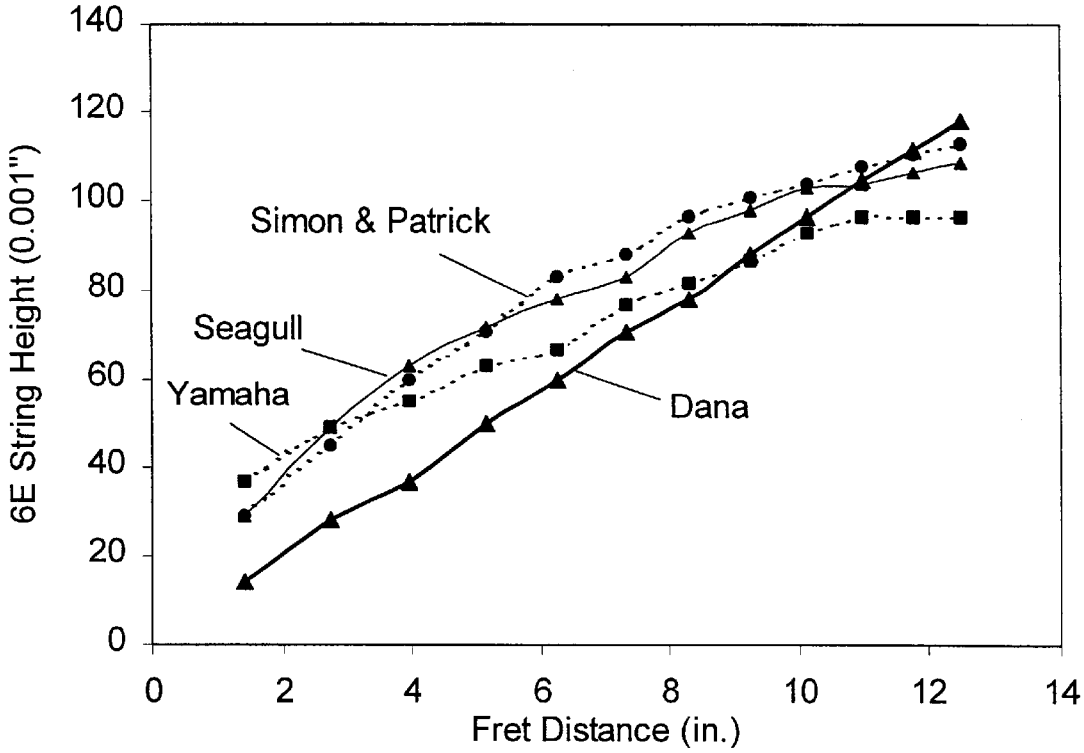
FIG. 15 illustrates a second set of string height characteristics of a molded fretboard according to the present invention in comparison to 3 conventional guitars.
Figure 16:
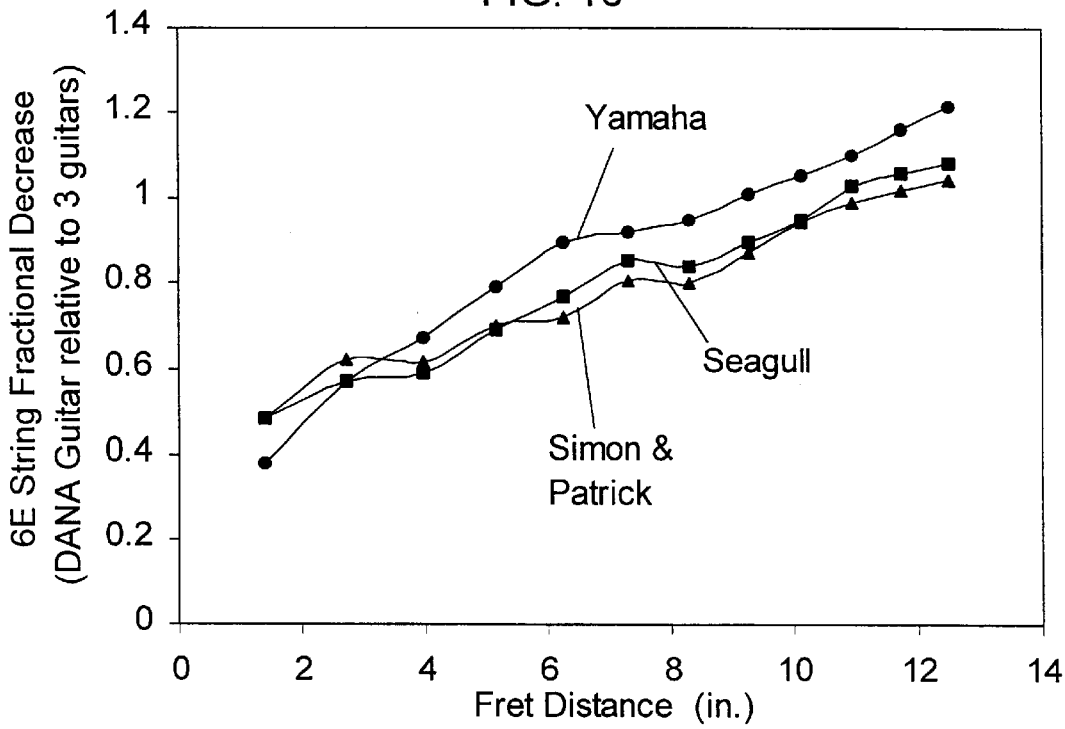
FIG. 16 illustrates a fractional decrease or improvement of the guitar with the molded fretboard according to the present invention relative to the conventional guitars as compared in FIG. 15.

String height measurements for the 6E string are presented in FIG. 15. Again the DANA guitar clearly indicates the strings heights to be linear over the entire fretboard with a precision of 0.001" and having string heights ranging from 0.014–0.118". The conventional guitars also show higher string heights overall and in all cases converge at higher frets, i.e. #6–12. FIG. 16 shows the fractional decrease or improvement gained with the new fretboard. Here also, the largest improvements in string heights occurs at the lower frets #1–5 where the average fractional decrease in string heights was 0.4–0.5 thereby resulting in an improvement of approximately 2×. The string heights at fret #12 remained constant and no gains were realized.

As a result of the new molded fretboard mounted on the DANA guitar, the largest improvements in string heights were seen to occur at the lower frets #1–5. This supports previous observations, which indicated that conventional guitars tend to have excess clearance in the lower frets #1–5 to compensate for buzzing. Hence these are the regions where most of the gains can be realized. What is most significant for a user's perspective is that most of the basic and common chords occur in frets #1–5 and therefore these improvements are most attractive to the beginner or amateur player who spends 95% of their time playing in this region and would find this a very 'low action' guitar to play. The characteristics described above are a result of both the composition of the molded fretboard and of the preferred installation process, as described above, although either of these two may contribute individually to the observed improved characteristics.

Fitting a Conventional Wood Fretboard

The principle of using a straight fretboard may also be applied to a conventional wooden fretboard. An inexpensive guitar (Oscar-Schmidt™) was used, the fretboard removed from the neck and reduced in thickness by 1/16". The fretboard was then mounted on straight steel edges corresponding to the procedure shown in FIG. 12A and attached to the neck in accordance with the procedure shown in FIG. 12B, each of which will be described in detail below. The fractional decrease in string heights was similar to that obtained with the DANA guitar shown in FIGS. 14 & 16; however, the absolute heights were slightly greater than those obtained with the DANA guitar. This was due to the fact that the gaps between strings and fret tops were large to begin with, since the fret heights of the original wood fretboard of the Oscar-Schmidt varied from linearity by as much as 0.005". Ideally, however, given that an accurate linear (<0.002") wooden fretboard with conventional frets can be constructed, the mounting process described below can be also applied and ideal results obtained.

To summarize, a method of installing a fretboard (whether molded or conventional) onto a stringed musical instrument prior to the final securing of the fretboard to the neck has been described, the method comprising the steps of: initially securing the fretboard to the neck after the strings have already been properly tensioned and tuned; removably attaching one or more linear steel edges to the upper surface of the fretboard, whereby the steel edges ensure the linearity of the fretboard, regardless of the curvature of the neck; adjusting, with an adjusting means, the height of the fretboard relative to the neck; injecting an adhesive between the fretboard and the neck; and removing the steel edges once the adhesive is bound. This method may optionally comprise, before the step of removably attaching one or more linear steel edges to the upper surface of the fretboard, ensuring that the guitar neck and nut are in proper position.

The principle of the installation process is that the 'straight' fretboard is attached after the neck curvature is set. The fretboard remains straight providing the same gauge of strings are always used on the guitar providing the same overall tensions. This method provides solutions to the problem of having a bowed neck and the problem of having a non-straight fretboard simultaneously. As such, a method according to the present invention may be used to ensure the linearity of a fretboard/fingerboard on a stringed musical instrument. A method according to the present invention may also be used to ensure the linearity of a neck of a stringed musical instrument.

Molded Compact & Portable Guitar

A molded compact and portable stringed musical instrument is capable of being constructed in accordance with the steps previously identified. A molded guitar in accordance with an embodiment of the present invention can be constructed in many different sizes, the scale length being variable because of the fabrication process used. Although any number of scale lengths may be used, an exemplary embodiments of a guitar with a 19" scale lengths will be described herein, although a guitar with a 25" scale length may be constructed in a similar manner. An advantage afforded by the molded stringed musical instrument in accordance with an embodiment of the present invention is that the length of the guitar is only slightly greater than the chosen scale length.

Figure 17:
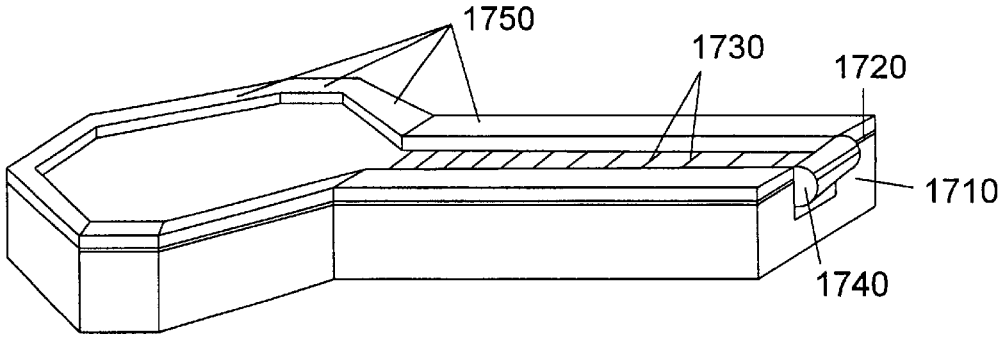
FIG. 17 illustrates a mold and base used to fabricate a molded guitar in accordance with another embodiment of the present invention.

A mold was built for fabrication of a small compact and portable electric guitar. FIG. 17 illustrates a mold and base used to fabricate a molded guitar in accordance with another embodiment of the present invention. A base 1710, preferably made of PVC, is constructed to accept a mold plate 1720. The surface of the base 1710 is preferably straight and level with an accuracy of <0.001". The mold plate 1720 is preferably fabricated from polypropylene plate material used for its properties of "quick release" of the cured resin form. Fret grooves 1730, for instance, twelve in number in a particular embodiment, are milled to a shallower depth of 0.025" using the scale rule as before and using a scale length of 19". A tubular roller "nut" is placed in a single groove 1740 cut to a depth of 0.095" and a radius of ⅝" at the end of the neck. The nut used in a particular embodiment is a ⅝" LEXAN tube with a wall thickness of 1/16" and will be described later in further detail with reference to FIGS. 19A and 19B. Strips 1750, preferably composed of polypropylene, are then cut and placed in a shape conforming to the desired outline of the guitar and attached to the base 1710 with attaching means (not shown), such as screws. The strips 1750 thus form side walls, which will contain the resin(s) when poured. The composite resin(s) and glass beads are prepared using the same procedure as that used for the molded fretboard, as described earlier. The neck is preferably strengthened by placing carbon fiber rods (not shown) in the neck channel of the plate 1720 and covering with Resin C.

As a result of this fabrication process, it is possible to produce a guitar with a total length that is only 1.25" greater than its scale length. Therefore, for a guitar with a 19" scale length, the total length of the guitar is 20.25". This small size, as well as the sturdiness of the molded guitar according to an embodiment of the present invention, make such a molded guitar suitable for a guitar player who wishes to have a practice guitar to bring while traveling without worrying about possible damage to a more expensive guitar. It is also suitable for a younger guitar player who may not be able to handle a larger sized guitar and who may benefit from the sturdiness of a molded guitar as opposed to a guitar constructed of wood.

In a preferred embodiment to be described below, the molded guitar in accordance with an embodiment of the present invention has strings that continue from the front side of the guitar over a roller assembly located at the top of the neck, and further continue along the back of the guitar neck, terminating at the tuning machines located at the center of the main body. The strings at the back of the neck are protected by a shaped LEXAN™ cover. A guitar-tuning transducer attached to the body is used to pick up string sounds which are amplified by the electronic circuit mounted on the back cover. The molded guitar according to an embodiment of the present invention can be heard using earphones only for privacy during practice or via an external speaker/amplifier, each of these arrangements being possible using components well known to those skilled in the art.

Roller Mechanism

Figure 18:
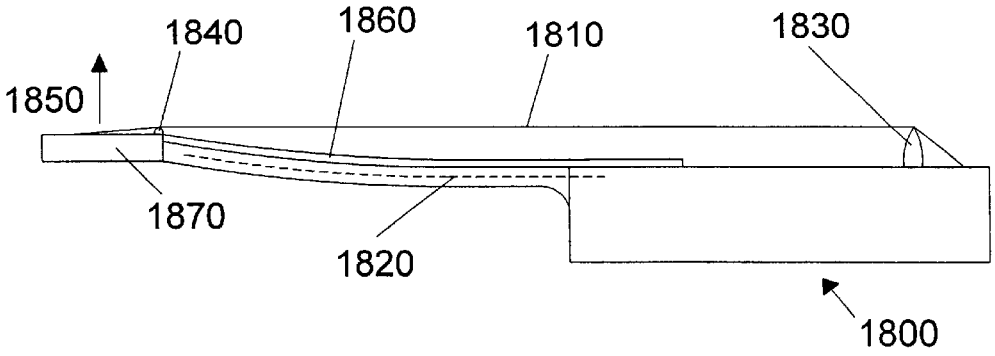
FIG. 18 PRIOR ART
FIG. 18 illustrates neck curvature caused by a resultant force exerted on a conventional guitar and fretboard installation.

In a conventional guitar 1800, as shown in FIG. 18, each string 1810 of guitar 1800 situated only above neck 1820 between bridge 1830 and nut 1840 exert a resultant force 1850 producing a neck curvature, resulting also in curvature of fretboard 1860. In such a conventional guitar 1800, the strings 1810 begin at the bridge 1830 and terminate at the tuning machines or pegs (not shown) located at the head 1870 of the guitar 1800.

In the case of a molded guitar according to another embodiment of the present invention, the strings are positioned in such a way as to minimize this force. If one were to wrap the strings around the head of the guitar, continue them along the back of the neck and body, and terminate them opposite the bridge, the resultant force 1850 shown in FIG. 18 would be balanced and hence minimized or even canceled with little or no accompanying neck curvature.

Figure 19A:
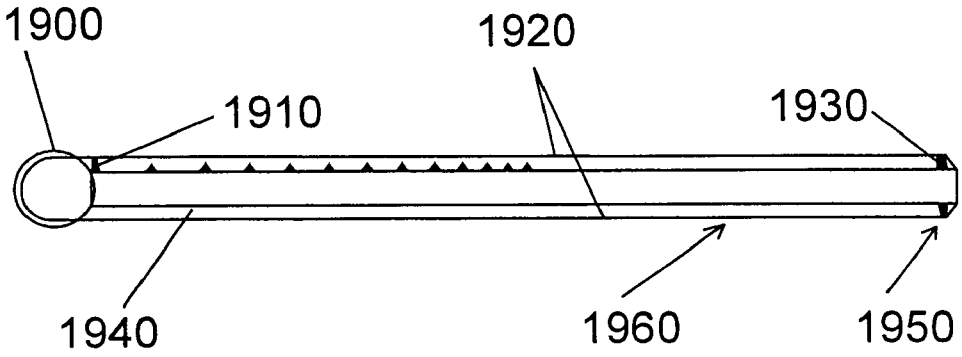
FIG. 19A illustrates a roller mechanism used in conjunction a molded guitar in accordance with an embodiment of the present invention.

This principle is applied to a molded guitar having a roller mechanism according to an embodiment of the present invention. With reference to FIG. 19A, roller mechanism 1900 is provided just behind nut 1910. For guitar strings 1920 originating at bridge 1930, passing over each of nut 1910 and roller 1900, and along the back 1940 of the guitar, the ideal string termination point 1950 would be opposite the bridge 1930 as shown. However, given that it is not feasible to terminate the strings 1920 at tuning machines or pegs behind the bridge 1930, the strings 1920 are terminated at a point near the ideal termination point 1950. The location of actual termination point 1960 is determined taking into account the desired maximum cancellation of forces while retaining a practical implementation in terms of the positioning of the tuning pegs. In an embodiment of the present invention, the actual string termination point 1960 is located at a position about 70% of the entire path from the bridge 1930 to the ideal string termination point 1950. Hence, in this configuration, approximately 70% of the resultant force is cancelled and the need for truss rod reinforcement is minimized.

Figure 19B:
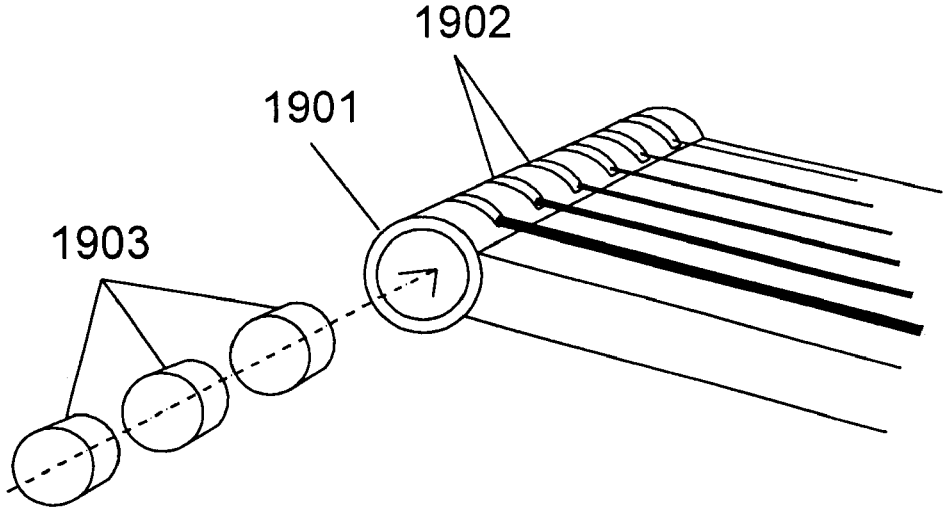
FIG. 19B illustrates an exploded view of the roller mechanism of FIG. 19A.

Cancellation of forces, however, would only occur if the strings could move freely. In this embodiment of the present invention, a roller mechanism 1900 is mounted at the head of the neck as shown in FIG. 19A. FIG. 19B illustrates an exploded view of the roller mechanism 1900. The roller mechanism 1900, or roller nut, at the top of the neck allows the strings to wrap around in the reverse direction and move back and forth with low friction while the tension of the strings is adjusted. A LEXAN tube 1901, with a plurality of grooves or slots 1902 cut therein for the passage of strings, is preferably mounted on the end of the neck during the resin curing process. The strings run through slots 1902 in the LEXAN tube 1901 and wrap around a plurality of individual nylon rollers 1903 inserted inside the tube 1901. In this example, the tube 1910 contains 6 independent cylindrical nylon disks 1903, which are lubricated and rotate with the travel of the strings. These rollers 1903 are preferably housed in alignment with the plurality of grooves 1902. The roller mechanism 1900 according to an embodiment of the present invention provides (near) frictionless rotation accommodating string travel as the strings are tensioned.

Two alternative methods may be used to bridge the strings at fret #0 position. In FIG. 19A, the nut 1910 was inserted at fret #0 prior to the strings running through the roller slots 1902. In FIG. 19B, the configuration does not use a nut but rather the string are supported on the edge of the slots 1902 milled within the roller mechanism 1900.

Another feature of this embodiment is that the strings are run through the inside of the neck which is preferably formed by a LEXAN cover. In this way, the strings are isolated behind the neck from the hand of the player.

Fret Height Characteristics and Guitar Performance

In the cases of both the 19" and 25" scale length molded guitars, the fretboard was constructed using the identical process at that employed for acoustic guitars as described earlier, however it was most practical to mold the guitar body and fretboard as a unit. The LEXAN cover serves as the neck simply to isolate the strings but does not serve as a structural unit. Hence the fretboard mounting process used with the acoustic guitars was not employed here. In this case, the fretboard, which also serves as the neck, alternatively has embedded within itself one or more truss rods, the use of which has been minimized as a result of the placement of strings at front and back of the guitar body which minimize the bending forces. Since the frets and fretboard were designed to be linear, the resultant gaps between strings and fret tops were comparable to those of the DANA acoustic guitar shown in FIGS. 12 & 14 and therefore resulted in a 'low action' guitar. There was however a slight neck curvature under string tension amounting to a 0.005" deviation from linear at frets #5–8 corresponding to about 20–25% of that experienced on a typical guitar neck.

The back LEXAN cover of a molded guitar according to an embodiment of the present invention serves to a) house the electronics and (b), when closed, to protect the tuning machines from unwanted adjustments in the event of jarring. A dual-coil pickup is amplified by the electronics, which provides an audio signal to either headphones or a compact amplifier/speaker. The LEXAN cover forms the back of the guitar neck and houses the strings.

Although various exemplary embodiments of the invention have been disclosed, it should be apparent to those skilled in the art that various changes and modifications can be made which will achieve some of the advantages of the invention without departing from the true scope of the invention.

I claim:

1. A molded fretboard for use with a musical instrument, said fretboard having frets molded integrally therewith, said frets having abrasion resistant characteristics and being composed, in a working region thereof, of a molded mixture including glass beads and resin, said mixture having a higher proportion by volume of glass beads than of resin, and said glass beads being compacted such that each glass bead is in contact with at least one other glass bead.

2. A molded fretboard according to claim 1 wherein said proportion of glass beads to resin is in the range of about 60:40 to 70:30.

3. A molded fretboard according to claim 1 wherein said fretboard is composed substantially entirely of a molding mixture including glass beads and resin, said mixture having a higher proportion by volume of glass beads than of resin, whereby the top surface of said fretboard is provided with abrasion resistance.

4. A molded fretboard according to claim 1 wherein said glass beads are solid glass beads having a diameter in the range of about 1 to 500 microns.

5. A molded fretboard according to claim 1 wherein said glass beads are solid glass beads having a diameter in the range of about 30 to 150 microns.

6. A molded fretboard according to claim 1 wherein said glass beads are composed of a material selected from the group comprising: sodalime, barium titanate, and borosilicate.

7. A molded fretboard according to claim 1 wherein said resin is composed of one or more materials selected from the group comprising: encapsulating epoxy resin, polymer resin, polyester resin, amine-cured epoxy resin, brominated epoxy resin, epoxy novolac resin, bisphenol-A/F based resin, glycidal-based epoxy resin, water-based epoxy resin, casting resin, UV-cured resin, epoxy-polamide combination, and any combination thereof.

8. A stringed musical instrument comprising:

a molded fretboard having frets molded integrally therewith, said frets having abrasion resistant characteristics and being composed, in a working region thereof, of a molded mixture including glass beads and resin, said mixture having a higher proportion by volume of glass beads than of resin, and said glass beads being compacted such that each glass bead is in contact with at least one other glass bead.

9. A stringed musical instrument according to claim 8 wherein said proportion by volume of glass beads to resin is in the range of about 60:40 to 70:30.

10. A stringed musical instrument according to claim 8 wherein said fretboard is composed substantially entirely of a molding mixture including glass beads and resin, said mixture having a higher proportion by volume of glass beads than of resin, whereby the top surface of said fretboard is provided with abrasion resistance.

11. A stringed musical instrument according to claim 8 wherein said glass beads are solid glass beads having a diameter in the range of about 1 to 500 microns.

12. A stringed musical instrument according to claim 8 wherein said glass beads are solid glass beads having a diameter in the range of about 30 to 150 microns.

13. A stringed musical instrument according to claim 8 wherein said glass beads are composed of a material selected from the group comprising: sodalime, barium titanate, and borosilicate.

14. A stringed musical instrument according to claim 8 wherein said resin is composed of one or more materials selected from the group comprising: encapsulating epoxy resin, polymer resin, polyester resin, amine-cured epoxy resin, brominated epoxy resin, epoxy novolac resin, bisphenol-A/F based resin, glycidal-based epoxy resin, water-based epoxy resin, casting resin, UV-cured resin, epoxy-polamide combination, and any combination thereof.

15. A process for producing a molded fretboard for use with a stringed musical instrument, comprising the steps of:

a) pouring a pre-mixed molding mixture of glass beads and resin into a mold plate comprising fret grooves to permit said glass beads to settle into at least the working region of the fret such that each glass bead is in contact with at least one other glass bead, said mixture having a higher proportion by volume of glass beads than of resin; and b) curing the resin to produce a molded fretboard having abrasion resistant frets integrally formed thereon.

16. A process according to claim 15 wherein said step a) is replaced by the following steps:

a1) pouring a molding mixture of glass beads into a mold plate comprising fret grooves, thus creating a glass bead layer in at least the working region of the fret such that each glass bead is in contact with at least one other glass bead, said mixture having a higher proportion by volume of glass beads than of resin;

a2) adding a layer of resin on top of the glass bead layer to form an initial thin layer of resin thereon; and a3) allowing the resin to permeate the glass bead layer, without disturbing the beads, so that the resin permeates throughout the entire bead volume including the fret grooves.

17. A process according to claim 15 further comprising the step of compressing said glass beads into the fret groove and reducing any air gaps within the fret surface, so as to increase the density per volume of glass beads.

18. A method of installing a molded fretboard according to claim 1 onto a stringed musical instrument prior to the final securing of the fretboard to the neck, said method comprising the steps of:

initially securing the fretboard to the neck after the strings have already been properly tensioned and tuned;

removably attaching a rigid body to the upper surface of the fretboard to ensure the linearity of the fretboard, regardless of the curvature of the neck;

adjusting, with a height adjusting means, the height of the fretboard relative to the neck;

injecting an adhesive between the fretboard and the neck; and removing the rigid body once the adhesive is bound.

19. A method according to claim 18 further comprising, before said step of removably attaching said rigid body to the upper surface of the fretboard, ensuring that the guitar neck and nut are in proper position.

20. A method according to claim 18 wherein said rigid body comprises one or more linear steel edges.

21. A method according to claim 18 wherein said height adjusting means is selected from the group consisting of: a shim and an adjusting screw.

22. A method of ensuring the linearity of a fretboard/fingerboard on a stringed musical instrument comprising the steps of:

removably attaching one or more linear steel edges to the upper surface of the fretboard to ensure the linearity of the fretboard, regardless of the curvature of the neck;

adjusting, with a height adjusting means, the height of the fretboard relative to the neck;

injecting an adhesive between the fretboard and the neck; and removing the steel edges once the adhesive is bound.

23. A method of ensuring the linearity of a neck of a stringed musical instrument comprising the steps of:

removably attaching one or more linear steel edges to the upper surface of the fretboard to ensure the linearity of the fretboard;

adjusting, with a height adjusting means, the height of the fretboard relative to the neck to establish linearity of the neck;

injecting an adhesive between the fretboard and the neck; and removing the steel edges once the adhesive is bound.

* * * * *